US012710203B2

(12) United States Patent
Arnou et al.

(10) Patent No.: US 12,710,203 B2
(45) Date of Patent: Aug. 18, 2026

(54) LUBRICATION SYSTEM FOR A COMPRESSOR

(71) Applicants: Johnson Controls Tyco IP Holdings LLP, Milwaukee, WI (US); Johnson Controls Industries SAS, Carquefou (FR)

(72) Inventors: Damien Jean Daniel Arnou, La Séguinière (FR); Francois Charles Andre Clunet, La Chapelle-sur-Erdre (FR); Paul Eric Le Sausse, Nantes (FR); Laurent Claude Eric Thibaud, Mouzillon (FR); Nicolas Jean Alain Brinon, Vertou (FR)

(73) Assignees: Tyco Fire & Security GmbH, Neuhausen am Rheinfall (CH); Johnson Controls Industries SAS, Carquefou (FR)

( * ) Notice: Subject to any disclaimer, the term of this patent is extended or adjusted under 35 U.S.C. 154(b) by 531 days.

(21) Appl. No.: 17/619,555

(22) PCT Filed: Jun. 11, 2020

(86) PCT No.: PCT/US2020/037291
§ 371 (c)(1),
(2) Date: Dec. 15, 2021

(87) PCT Pub. No.: WO2020/257056
PCT Pub. Date: Dec. 24, 2020

(65) Prior Publication Data

US 2022/0307739 A1 Sep. 29, 2022

Related U.S. Application Data

(60) Provisional application No. 62/862,536, filed on Jun. 17, 2019.

(51) Int. Cl.
*F25B 31/00* (2006.01)
*F25B 49/02* (2006.01)

(52) U.S. Cl.
CPC ..... *F25B 31/004* (2013.01); *F25B 49/02* (2013.01); *F25B 2341/0016* (2013.01); *F25B 2600/17* (2013.01); *F25B 2600/2513* (2013.01)

(58) Field of Classification Search
CPC ..... F25B 49/02; F25B 31/002; F25B 31/004; F25B 41/00; F25B 2341/0013–0016; F25B 2600/2513; F25B 2600/17
See application file for complete search history.

(56) References Cited

U.S. PATENT DOCUMENTS 3,600,904 A * 8/1971 Tilney ..... F25B 41/315 62/503
4,558,573 A 12/1985 La Monica
(Continued)

FOREIGN PATENT DOCUMENTS

CN 105074357 A 11/2015
DE 2164995 A1 9/1972
(Continued)

OTHER PUBLICATIONS

Korean Office Action for KR Application No. 10-2022-7001550, dated Nov. 20, 2023, 9 pages.
(Continued)

*Primary Examiner* — Frantz F Jules
*Assistant Examiner* — Webeshet Mengesha
(74) *Attorney, Agent, or Firm* — Fletcher Yoder, P.C.

(57) ABSTRACT

A heating, ventilation, air conditioning, and/or refrigeration (HVAC&R) system includes a refrigerant circuit configured to flow a refrigerant therethrough, a sump configured to direct a lubricant to a compressor, an ejector configured to direct the lubricant from the refrigerant circuit to the sump,
(Continued)

and an expansion device configured to reduce a pressure of the refrigerant directed through the refrigerant circuit. The HVAC&R system further includes a controller configured to instruct the expansion device to adjust to a first position to enable the ejector to direct lubricant from the refrigerant circuit to the sump at a first target flow rate in a first mode, and the controller is configured to instruct the expansion device to adjust to a second position to enable the ejector to direct lubricant from the refrigerant circuit to the sump at a second target flow rate in a second mode.

12 Claims, 9 Drawing Sheets

(56) References Cited

U.S. PATENT DOCUMENTS

| | | | | |
|---|---|---|---|---|
| 4,843,837 | A * | 7/1989 | Ogawa | F28D 7/0066 62/503 |
| 5,606,872 | A * | 3/1997 | Terasaki | F04D 29/063 62/84 |
| 6,457,325 | B1 | 10/2002 | Vetter | |
| 2013/0213083 | A1* | 8/2013 | Higashiiue | F25B 5/04 62/500 |
| 2016/0003511 | A1 | 1/2016 | Esformes et al. | |
| 2016/0047575 | A1* | 2/2016 | Jonsson | F25B 1/053 62/117 |

FOREIGN PATENT DOCUMENTS

| | | | |
|---|---|---|---|
| JP | S5738692 | A | 3/1982 |
| JP | 2001124421 | A | 5/2001 |
| JP | 2006275440 | A | 10/2006 |
| JP | 2007211716 | A | 8/2007 |
| JP | 2009257684 | A | 11/2009 |
| JP | 2013200058 | A | 10/2013 |
| JP | 2014190579 | A | 10/2014 |
| JP | 2015038407 | A | 2/2015 |
| JP | 2016020783 | A | 2/2016 |
| JP | 2018059663 | A | 4/2018 |
| WO | 2017085887 | A1 | 5/2017 |

OTHER PUBLICATIONS

International Search Report and Written Opinion for PCT Application No. PCT/US2020/037291, mailed Sep. 16, 2020, 14 pgs.
Japanese Office Action for JP Application No. 2021-575912, dated Jan. 20, 2023, 9 pages.
Chinese Office Action for CN Application No. 202080057435.3, dated Jan. 31, 2023, 7 pages.
Korean Office Action for KR Application No. 10-2022-7001550, dated Jul. 19, 2024, 6 pages.

* cited by examiner

LUBRICATION SYSTEM FOR A COMPRESSOR

CROSS REFERENCE TO RELATED APPLICATION

This application is a U.S. National Stage Application of PCT International Application No. PCT/US2020/037291, entitled "LUBRICATION SYSTEM FOR A COMPRESSOR." filed Jun. 11, 2020, which claims priority to and the benefit of U.S. Provisional Application Ser. No. 62/862,536, entitled "LUBRICATION SYSTEM FOR A COMPRESSOR," filed Jun. 17, 2019, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the chiller system. The chiller system may place a working fluid in a heat exchange relationship with a conditioning fluid and may deliver the conditioning fluid to conditioning equipment and/or a conditioned environment of the chiller system. The chiller system may also include a lubricant circuit to direct lubricant (e.g., oil) to certain components, such as a compressor, of the chiller system. However, in some circumstances, a rate at which the lubricant is directed to such components may not be easily controlled, which may impact a performance of the chiller system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, air conditioning, and/or refrigeration (HVAC&R) system includes a refrigerant circuit configured to flow a refrigerant therethrough, a sump configured to direct a lubricant to a compressor positioned along the refrigerant circuit, an ejector configured to direct the lubricant from the refrigerant circuit to the sump, and an expansion device positioned along the refrigerant circuit and configured to reduce a pressure of the refrigerant directed through at least a portion of the refrigerant circuit. The HVAC&R system further includes a controller configured to adjust operation of the HVAC&R system between a first mode and a second mode, in which the controller is configured to instruct the expansion device to adjust to a first position to enable the ejector to direct the lubricant from the refrigerant circuit to the sump at a first target flow rate in the first mode, and the controller is configured to instruct the expansion device to adjust to a second position to enable the ejector to direct the lubricant from the refrigerant circuit to the sump at a second target flow rate in the second mode.

In another embodiment, a heating, ventilation, air conditioning, and/or refrigeration (HVAC&R) system includes a refrigerant circuit, a lubricant circuit, and a sump positioned along the lubricant circuit, in which the sump is configured to direct lubricant to the refrigerant circuit. The HVAC&R system further includes an ejector positioned along the lubricant circuit, in which the ejector is configured to direct the lubricant from the refrigerant circuit to the sump, the ejector is configured to receive a first fluid flow from a condenser positioned along the refrigerant circuit via an inlet of the ejector in a first mode of operation of the HVAC&R system, and the ejector is configured to receive a second fluid flow from a compressor positioned along the refrigerant circuit via the inlet of the ejector in a second mode of operation of the HVAC&R system.

In another embodiment, a heating, ventilation, air conditioning, and/or refrigeration (HVAC&R) system includes a refrigerant circuit, an expansion device positioned along the refrigerant circuit, a sump configured to direct lubricant to the refrigerant circuit, and an ejector configured to draw the lubricant from the refrigerant circuit. The expansion device is configured to reduce a pressure of refrigerant directed through at least a portion of the refrigerant circuit and the ejector is configured to receive a first fluid flow from a condenser positioned along the refrigerant circuit in a first mode of operation of the HVAC&R system, and to receive a second fluid flow from a compressor positioned along the refrigerant circuit in a second mode of operation of the HVAC&R system. The HVAC&R system further includes a controller configured to transition the HVAC&R system between the first mode of operation and the second mode of operation, in which the controller is configured to adjust a position of the expansion device to adjust the pressure of the refrigerant to a first pressure level in the first mode of operation, and to adjust the pressure of the refrigerant to a second pressure level in the second mode of operation, in which the second pressure level is less than the first pressure level.

DRAWINGS

Various aspects of this disclosure may be better understood upon reading the following detailed description and upon reference to the drawings in which.

Figure 7:
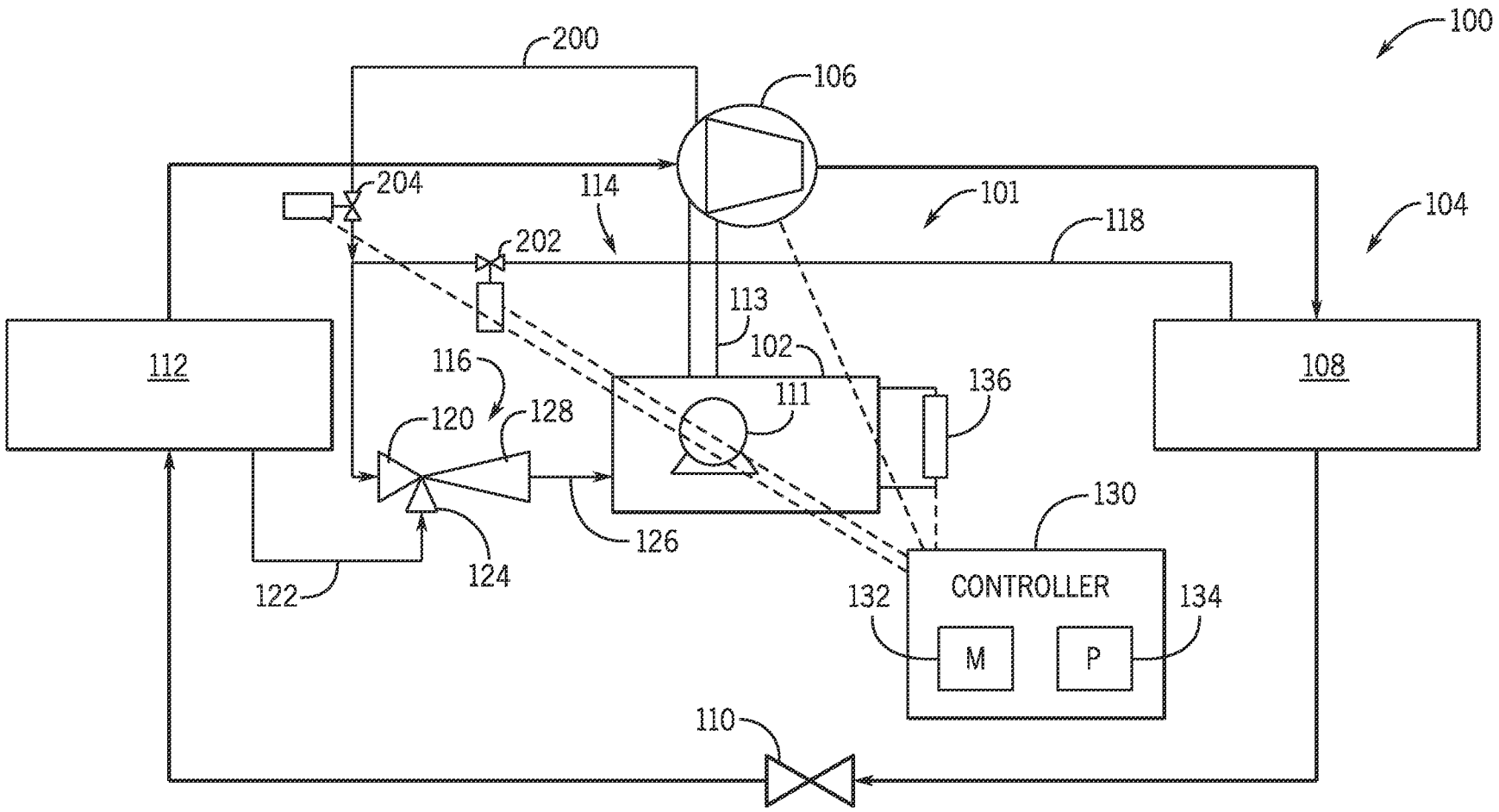
FIG. 7 is a schematic view of an embodiment of a lubricant return system of an HVAC&R system having a sump and a valve assembly for directing lubricant to a compressor of the HVAC&R system, in accordance with an aspect of the present disclosure.
Figure 8:
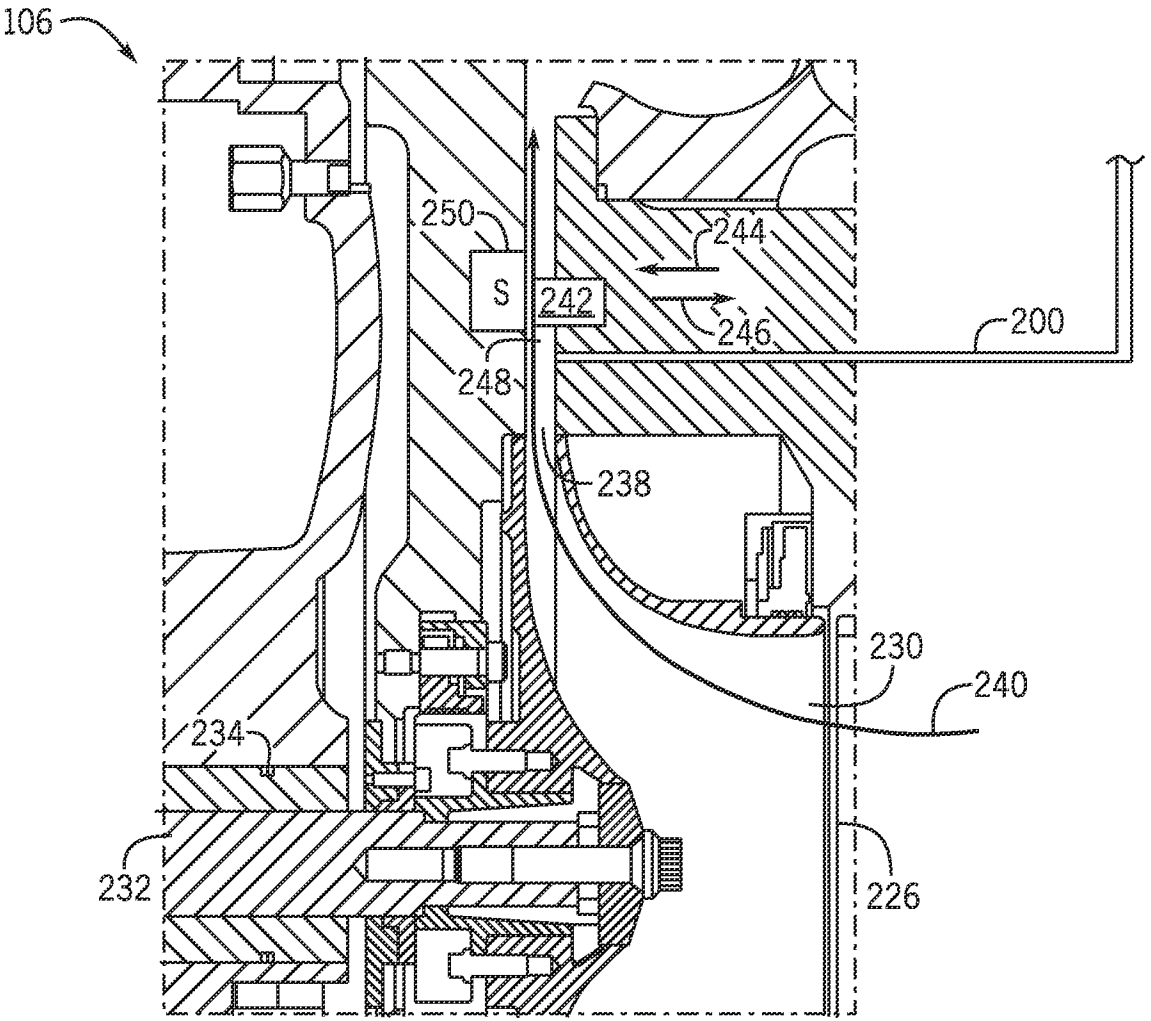
Figure 9:
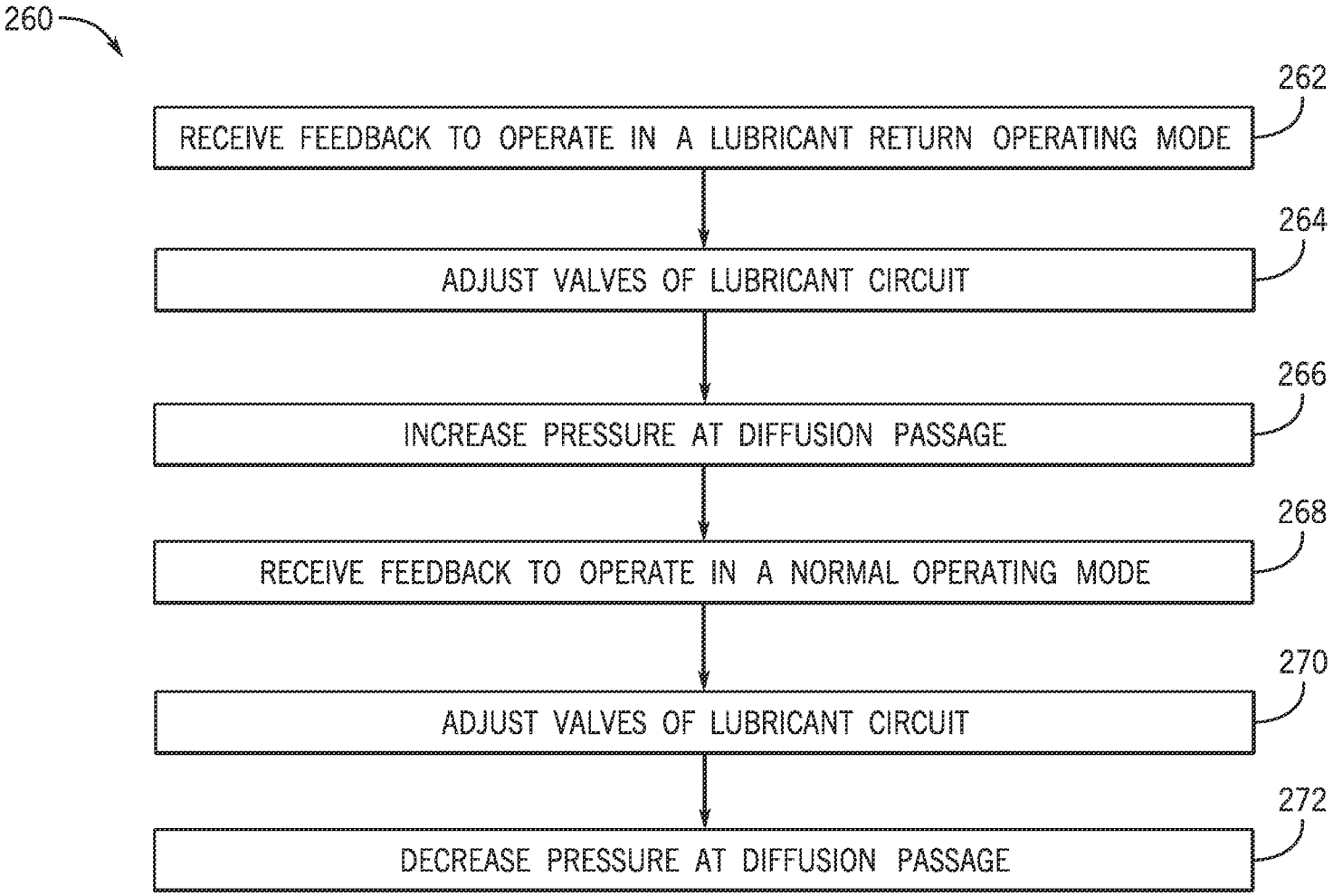

FIG. 8 is a partial cross-section of an embodiment of a compressor of an HVAC&R system configured to direct vapor to an ejector of a lubricant return system, in accordance with an aspect of the present disclosure; and FIG. 9 is a block diagram of an embodiment of a method for operating the lubricant return system of FIG. 7 to transition between a lubricant return operating mode and a normal operating mode, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to an HVAC&R system having a refrigerant circuit and a lubricant circuit configured to direct lubricant to components (e.g., a compressor) of the refrigerant circuit. For example, the refrigerant circuit may include various components that operate to condition a refrigerant directed through the refrigerant circuit, and the refrigerant circuit may place the refrigerant in a heat exchange relationship with a conditioning fluid to heat and/or cool the conditioning fluid. The lubricant circuit may direct the lubricant to the components of the refrigerant circuit to facilitate and/or improve operation of the components, such as by improving movement of the components and/or by reducing friction between moving features of the components, in order to improve a performance, such as an efficiency and/or a structural longevity, of the refrigerant circuit to condition the refrigerant.

In some embodiments, the lubricant circuit includes a sump configured to direct the lubricant to a component positioned along the refrigerant circuit of the HVAC&R system. The lubricant circuit may also include an ejector configured to draw a flow of the lubricant from the refrigerant circuit to return the lubricant to the sump, thereby enabling the sump to re-supply the lubricant to another component to further facilitate operation of the refrigerant circuit. Unfortunately, in some circumstances, the lubricant may accumulate within various components of the refrigerant circuit and, under some operating conditions, a sufficient flow rate of the lubricant is not directed back to the sump. Accordingly, the sump may not include a sufficient amount of the lubricant to supply to components of the refrigerant circuit at a desirable rate, thereby impacting a performance of the HVAC&R system.

Accordingly, it is now recognized that increasing the rate at which the lubricant returns to the sump may improve the performance of the HVAC&R system. Thus, embodiments of the present disclosure are directed to adjusting operation of various components of the HVAC&R system to increase the rate at which the lubricant flows from the refrigerant circuit, such as from a section of the refrigerant circuit where accumulation of the lubricant is not desirable, to the sump. The sump may then readily supply the lubricant to another section of the refrigerant circuit where the flow of lubricant is desirable. In certain embodiments, the HVAC&R system may be configured to transition between operating in a first operating mode (e.g., a normal operating mode) and a second operating mode (e.g., a lubricant return mode) based on feedback indicative of an operating parameter of the HVAC&R system so as to direct the lubricant from the refrigerant circuit to the sump at a different rates. As an example, a controller may instruct the HVAC&R system to operate in the lubricant return mode upon receiving feedback indicative that an amount (e.g., a fluid volume, a level) of lubricant in the sump is below a threshold amount. In the lubricant return mode, a speed of a compressor, a position of a diffuser ring, and/or a position of an expansion device of the HVAC&R system may be adjusted to increase the rate at which the lubricant is directed from the refrigerant circuit to the sump. Although the present disclosure is primarily discussed with reference to a chiller system, the techniques described herein may be implemented with any suitable HVAC&R system, such as a direct expansion system, a heat pump, and so forth.

Figure 1:
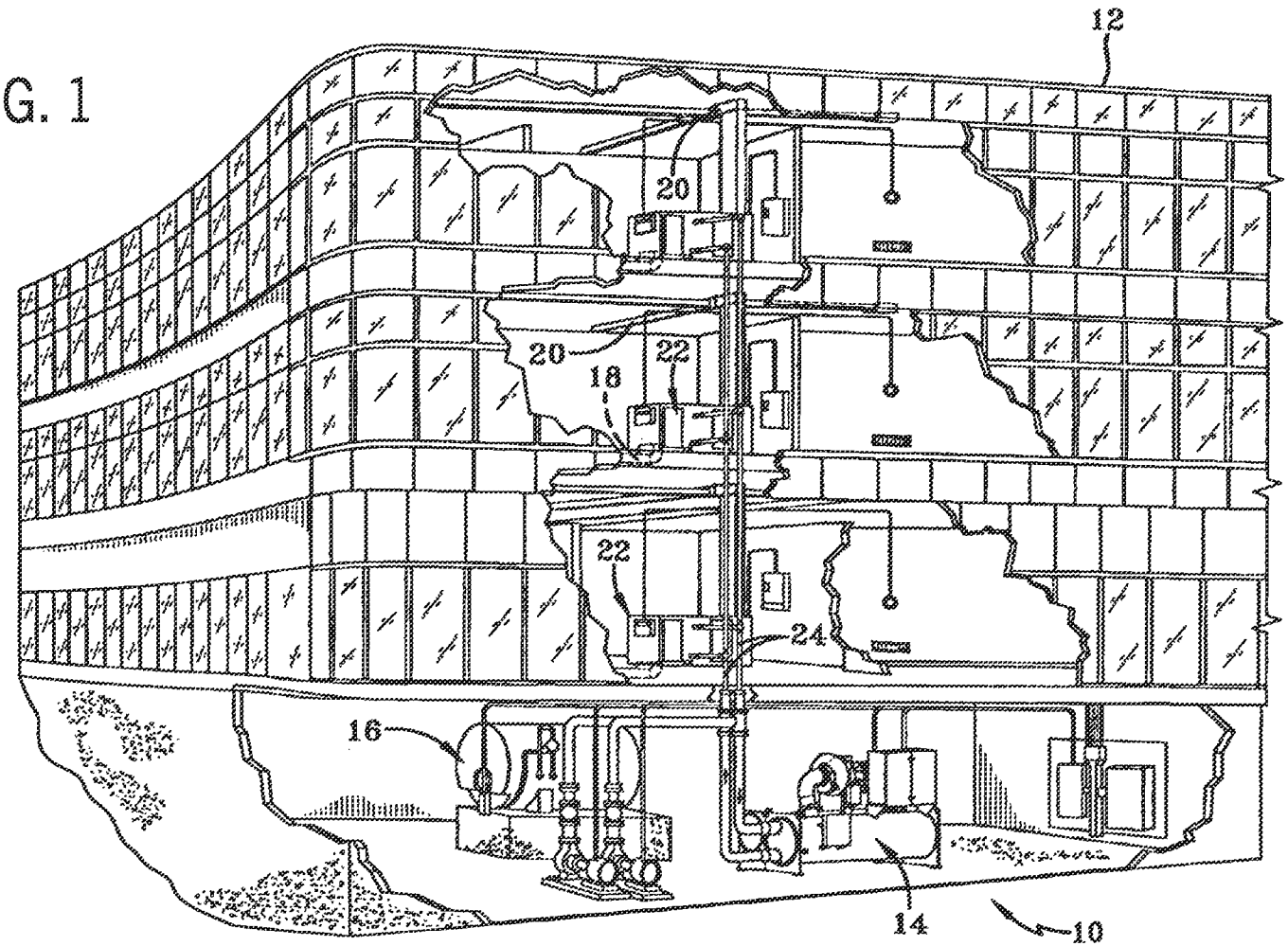
FIG. 1 is a perspective view of a building that may utilize an embodiment of a heating, ventilation, air conditioning, and/or refrigeration (HVAC&R) system in a commercial setting, in accordance with an aspect of the present disclosure.

Turning now to the drawings, FIG. 1 is a perspective view of an embodiment of an environment for a heating, ventilation, and air conditioning (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
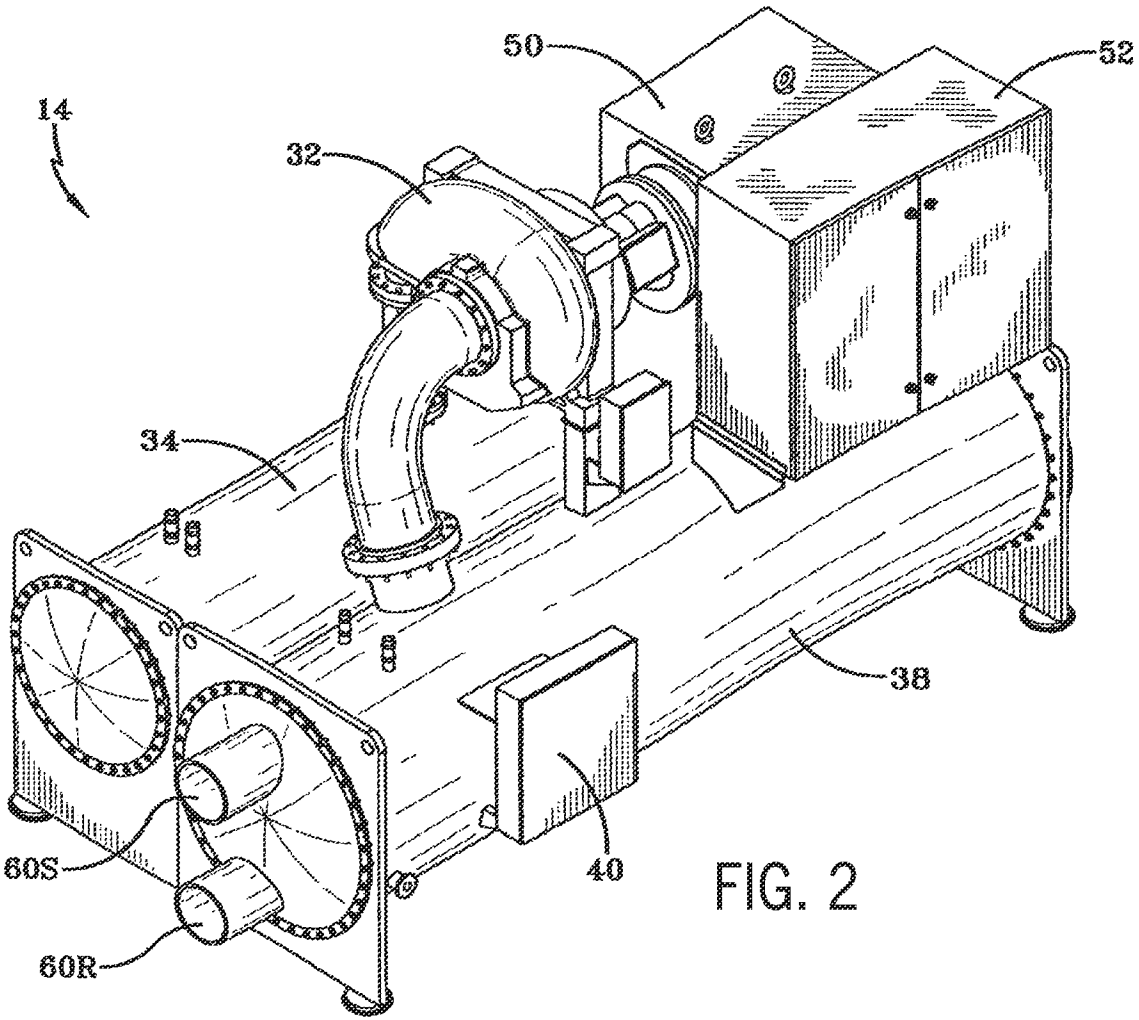
FIG. 2 is a perspective view of an embodiment of a vapor compression system, in accordance with an aspect of the present disclosure.
Figure 3:
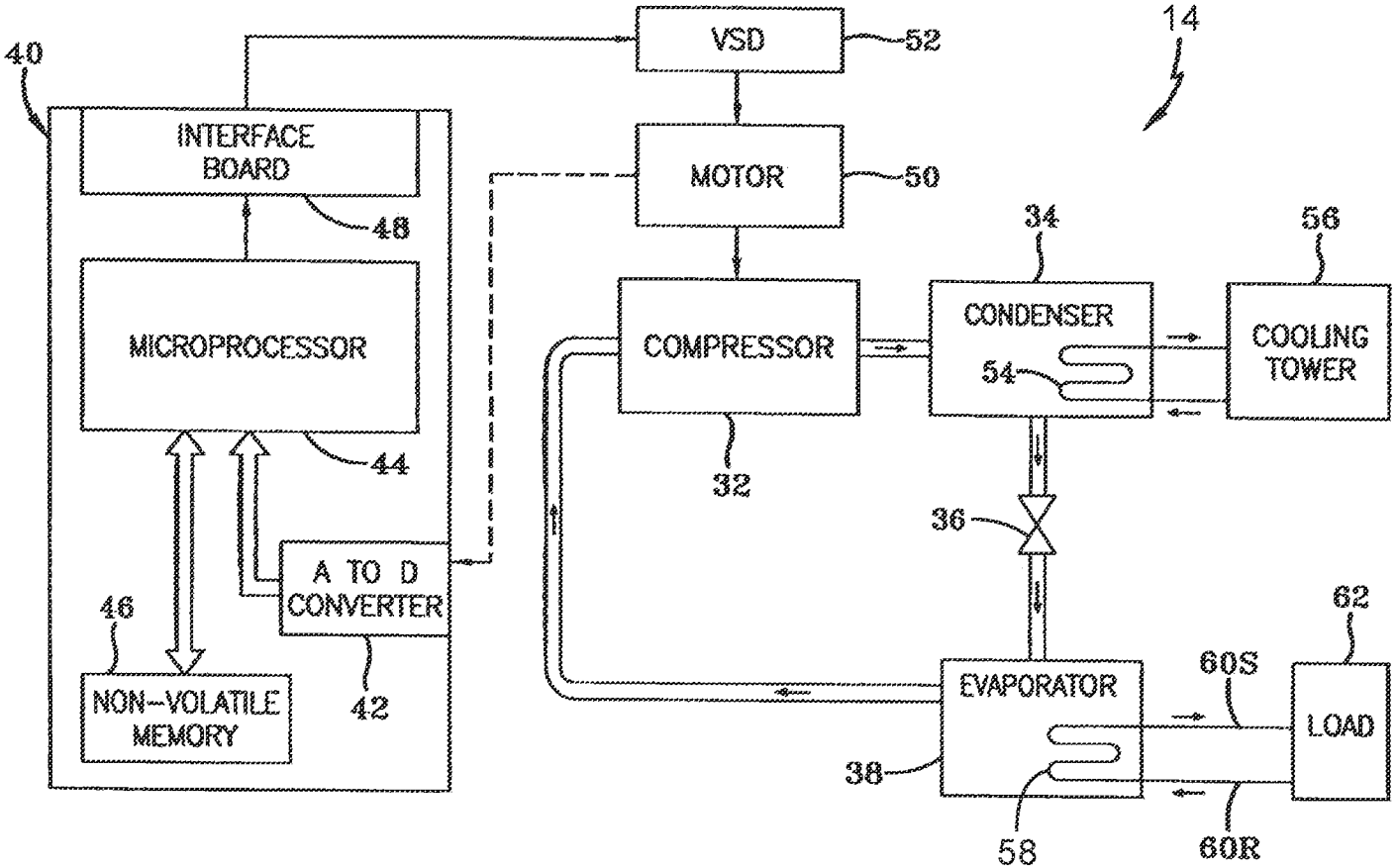
FIG. 3 is a schematic view of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, refrigerants with low global warming potential (GWP), or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
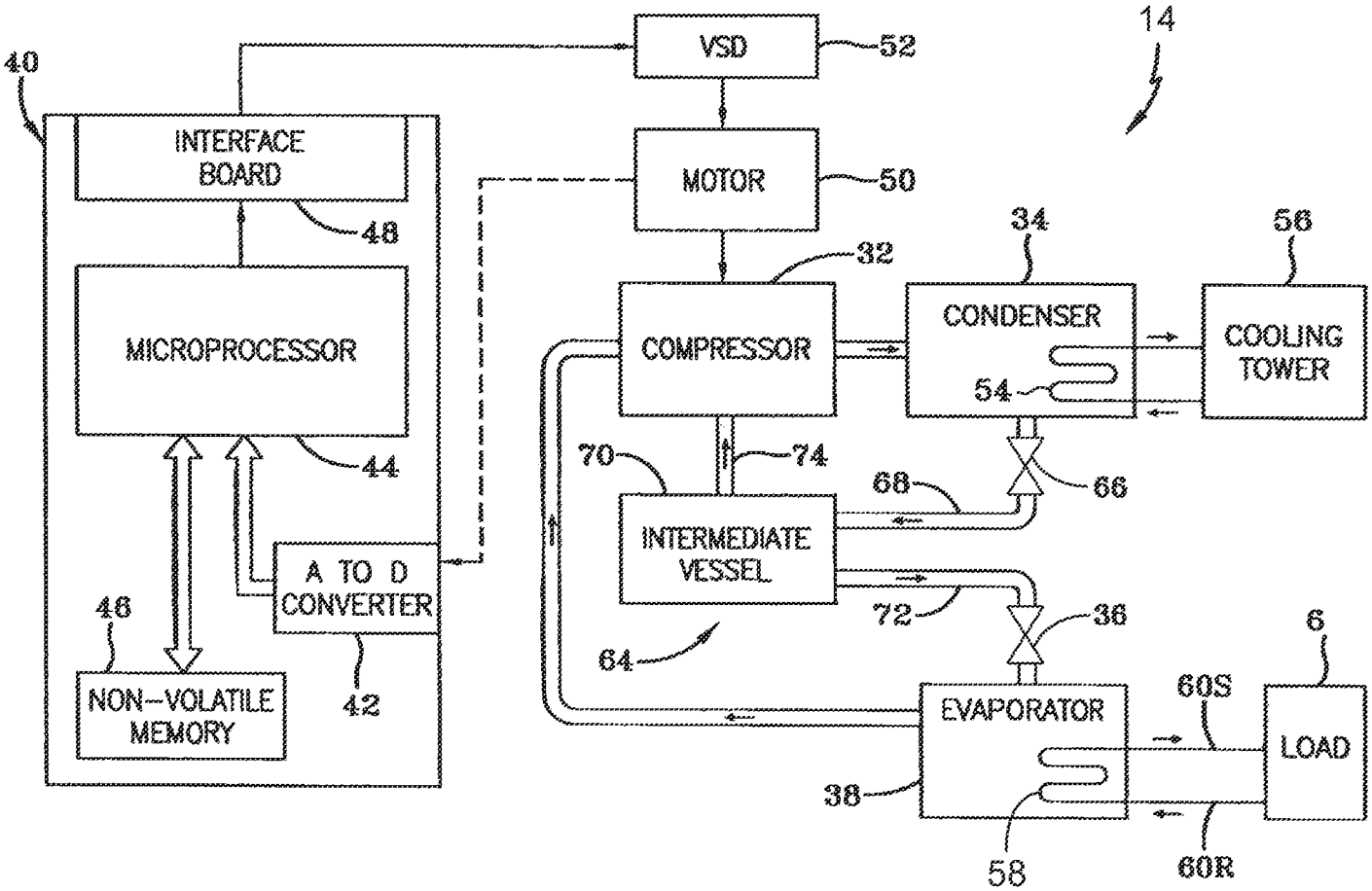
FIG. 4 is a schematic view of another embodiment of the vapor compression system of FIG. 2, in accordance with an aspect of the present disclosure.

FIG. 4 is a schematic view of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

An HVAC&R system may include a lubricant circuit that is configured to direct a lubricant to certain components of a refrigerant circuit of the HVAC&R system. The lubricant may enhance a performance of the components, such as by reducing friction between moving features of the components. The lubricant circuit may include a sump configured to receive the lubricant from and supply the lubricant to the refrigerant circuit. The lubricant circuit may also include an ejector configured to draw the lubricant from the refrigerant circuit and direct the refrigerant into the sump by establishing a pressure differential between a location along the refrigerant circuit and an interior of the sump. In some cases, the amount of lubricant in the sump may fall below a threshold amount. For instance, a pressure differential established by the ejector may not be sufficient to return the lubricant to the sump at a target flow rate (e.g., relative to a flow rate at which the lubricant is directed out of the sump). As such, the HVAC&R system may be configured to operate in a lubricant return mode, in which the operation of certain components of the HVAC&R system is adjusted to increase the pressure differential generated by the ejector and thus, increase a flow rate of the lubricant back to the sump.

Figure 5:
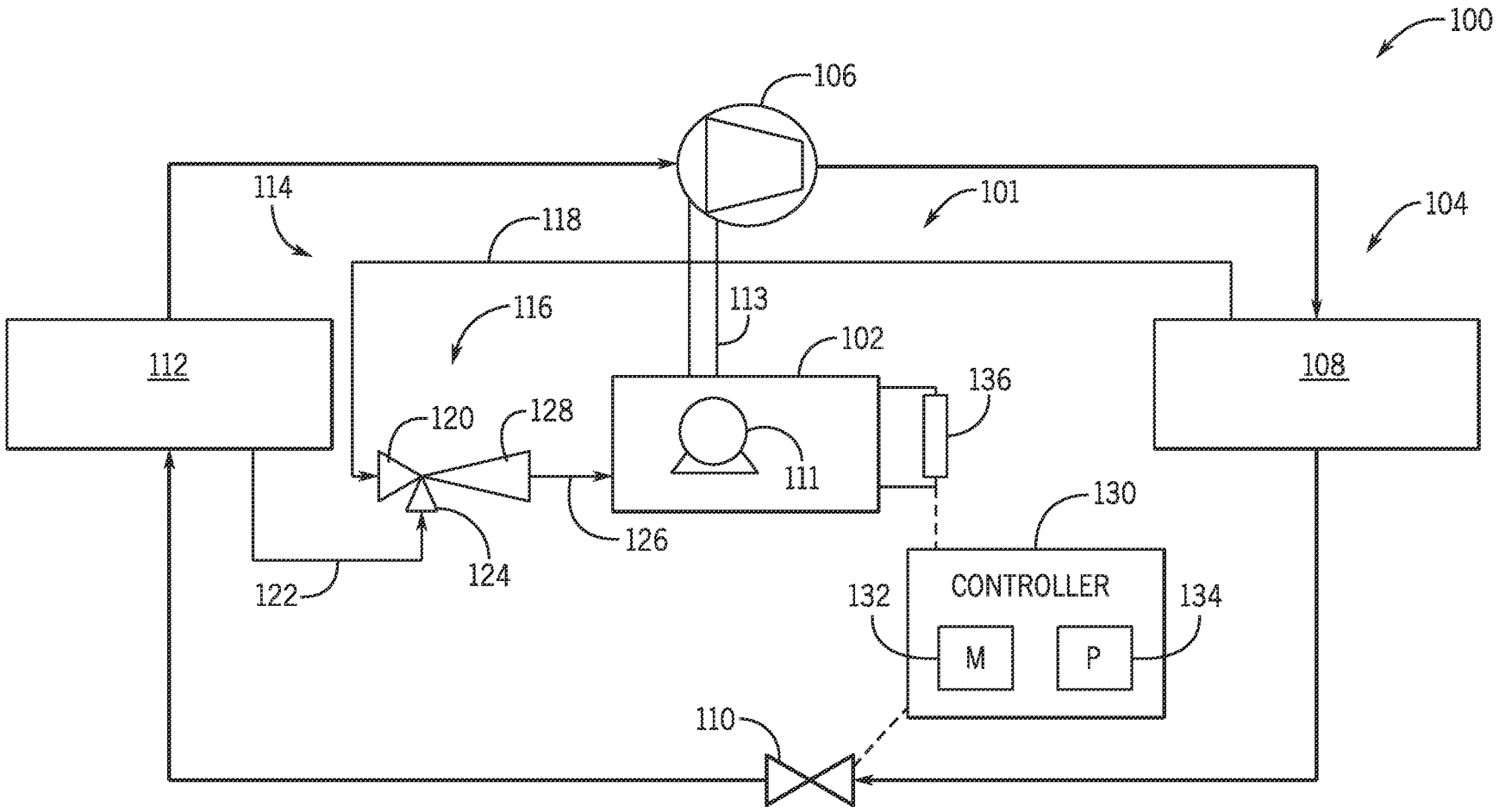
FIG. 5 is a schematic view of an embodiment of a lubricant return system for an HVAC&R system having a sump configured to direct a lubricant to a compressor of the HVAC&R system, in accordance with an aspect of the present disclosure.

FIG. 5 is a schematic view of an embodiment of an HVAC&R system 100 having a lubricant circuit 101 that includes a sump 102 configured to receive and supply a lubricant (e.g., oil) to and from components of the HVAC&R system 100. For example, the HVAC&R system 100 may include a refrigerant circuit 104 through which a refrigerant or other working fluid (e.g., water) is directed. The refrigerant circuit 104 may include a compressor 106 configured to pressurize the refrigerant and direct pressurized refrigerant to a condenser 108 of the refrigerant circuit 104, where the condenser 108 is configured to cool the pressurized refrigerant. The cooled refrigerant may be directed to an expansion device 110, such as the expansion device 36, configured to decrease a pressure of the refrigerant, which may further cool the refrigerant. The expansion device 110 then directs the refrigerant to an evaporator 112 configured to place the refrigerant in a heat exchange relationship with a conditioning fluid to absorb thermal energy (e.g., heat) from the conditioning fluid. The refrigerant is then drawn from the evaporator 112 back toward the compressor 106. The illustrated compressor 106 is fluidly coupled to the sump 102 and is configured to receive the lubricant from the sump 102. As an example, a pump 111 of the sump 102 may force or direct the lubricant from the sump 102 through a lubricant supply line 113 to the compressor 106, where the lubricant may lubricate components of the compressor 106 (e.g., bearings, gears) to enable the compressor 106 to maintain a structural longevity, useful life, and/or a particular performance that sufficiently and efficiently pressurizes the refrigerant.

In some cases, the lubricant mixes with the refrigerant within the compressor 106 and is directed through the refrigerant circuit 104, such as to the condenser 108 and/or to the evaporator 112. In order to return the lubricant back to the sump 102, the lubricant circuit 101 includes an ejector 116. For example, the lubricant circuit 101 may include a condenser line 118 fluidly coupling the condenser 108 to a first input or inlet 120 of the ejector 116. The lubricant circuit 101 may also include an evaporator line 122 fluidly coupling the evaporator 112 to a second input or inlet 124 of the ejector 116. The lubricant circuit 101 may further include a return line 126 coupling an outlet 128 of the ejector 116 to the sump 102. In some embodiments, a pressure differential between the condenser 108 and an interior of the ejector 116 may cause high pressure vapor or gas, such as lubricant vapor and/or refrigerant vapor that has not condensed within the condenser 108, to flow from the condenser 108 through the condenser line 118 to the first input 120 of the ejector 116.

The movement of the high pressure vapor into the ejector 116 may also create a suction pressure in the evaporator line 122 that draws liquid, such as refrigerant liquid and/or lubricant liquid, from the evaporator 112 into the second input 124 of the ejector 116. For example, high pressure vapor from the condenser 108 may expand within the ejector 116 and generate a low pressure (e.g., a vacuum), which drives or draws liquid from within the evaporator 112 to flow toward the second input 124 via the evaporator line 122. The high pressure vapor from the condenser 108 and the liquid from the evaporator 112 may combine and/or mix within the ejector 116 and flow through the outlet 128 of the ejector 116 into the sump 102 via the return line 126. In certain embodiments, the lubricant circuit 101 may additionally include a separator (e.g., a flash vessel) configured to separate the lubricant from the refrigerant. For instance, the separator may include a vessel that rapidly reduces a pressure of a mixture of the lubricant and refrigerant. As such, the separator may direct refrigerant vapor to the compressor 106 and/or to another suitable location along the refrigerant circuit 104, and the separator may direct the lubricant into the sump 102. As such, the sump 102 may primarily contain the lubricant, rather than refrigerant.

Generally, increasing pressurization of the refrigerant via the compressor 106 may increase the pressure of the refrigerant in the condenser 108, thereby increasing a flow rate at which refrigerant and/or lubricant are directed from the condenser 108 toward the ejector 116. The increased flow rate may increase a pressure differential between the evaporator 112 and the ejector 116 to increase the rate at which refrigerant and/or lubricant are drawn into the ejector 116 from the evaporator 112. Accordingly, increasing a pressure of the refrigerant discharged from the compressor 106 may increase the flow rate of the lubricant directed from the refrigeration circuit 104 to the ejector 116 and/or to the sump 102. Therefore, an increased amount of lubricant may accumulate within the sump 102 to enable sufficient lubrication of the components of the HVAC&R system 100 and improve performance of the HVAC&R system 100.

Under some operating conditions, the lubricant may not be returned to sump 102 at a rate that enables sufficient lubrication of the compressor 106. For example, a low pressure differential between the condenser 108 and the evaporator 112 may cause a low flow rate of the lubricant (and/or a mixture of refrigerant and lubricant) from the refrigerant circuit 104 into the ejector 116, such that a liquid level of lubricant within the sump 102 decreases. As such, the sump 102 (e.g., the pump 111) may not be able to supply a sufficient amount (e.g., a mass flow rate) of the lubricant to the compressor 106. To increase the liquid level of the lubricant within the sump 102, the HVAC&R system 100 may transition between a normal operating mode (e.g., an operating mode to effectively satisfy a load demand of the HVAC&R system 100) to a lubricant return operating mode (e.g., an operating mode to effectively increase lubricant flow to the sump 102).

In some embodiments, operation of the HVAC&R system 100 in the lubricant return operating mode may increase the concentration of lubricant liquid in the evaporator 112. In other words, the lubricant return operating mode may adjust operation of the HVAC&R system 100 to enable the heat transfer between the conditioning fluid and the refrigerant to vaporize a greater amount of refrigerant (e.g., of the refrigerant and lubricant mixture) in the evaporator 112 relative to that in the normal operating mode of the HVAC&R system 100. For example, the evaporating temperature of the refrigerant in the evaporator 112 during the lubricant return operating mode may be substantially lower than the evaporating temperature in the evaporator 112 during the normal operating mode to enable a greater amount of refrigerant to evaporate with substantially the same amount of heat transfer and without substantially increasing evaporation of the lubricant liquid. In this manner, less refrigerant liquid accumulates within the evaporator 112 during the lubricant return operating mode, thereby increasing a concentration of lubricant liquid in the evaporator 112. As such, if the flow rate at which the lubricant and/or refrigerant mixture is directed from the evaporator 112 to the ejector 116 during the lubricant return operating mode is substantially the same as that during the normal operating mode, the increased concentration of lubricant in the evaporator 112 may enable an increased amount (e.g., an increased volumetric flow rate) of lubricant to return to the sump 102 during the lubricant return operating mode.

To this end, a position of the expansion device 110 may be adjusted to reduce a pressure within the evaporator 112 and therefore also reduce the evaporating temperature of the refrigerant. As an example, the position of the expansion device 110 may be adjusted such that the evaporating temperature of the refrigerant in the lubricant return operating mode is between 1 degrees Celsius and 5 degrees Celsius below the evaporating temperature of the refrigerant in the normal operating mode. In certain embodiments, the position of the expansion device 110 may be adjusted automatically (e.g., electronically), such as via a controller 130 communicatively coupled to the expansion device 110. The controller 130 may include a memory 132 and a processor 134. The memory 132 may be a mass storage device, a flash memory device, removable memory, or any other non-transitory computer-readable medium that includes instructions for controlling of the HVAC&R system 100. The memory 132 may also include volatile memory, such as randomly accessible memory (RAM) and/or non-volatile memory, such as hard disc memory, flash memory, and/or other suitable memory formats. The processor 134 may execute the instructions stored in the memory 132, such as instructions to adjust the position of the expansion device 110.

It should be noted that, in some circumstances, the HVAC&R system 100 may operate more efficiently and/or desirably in the normal operating mode than in the lubricant return operating mode, such as to provide a desirable amount of cooling to the conditioning fluid more efficiently. By way of example, the HVAC&R system 100 may operate more efficiently in the normal operating mode when components of the refrigerant circuit 104 receive an adequate amount or flow rate of the lubricant. However, in other circumstances, the HVAC&R system 100 may operate more efficiently and/or desirably in the lubricant return operating mode than in the normal operating mode. For example, the HVAC&R system 100 may operate more efficiently in the lubricant return operating mode when components of the refrigerant circuit 104 are otherwise not receiving an adequate amount of lubricant. Therefore, the controller 130 may operate the HVAC&R system 100 in a particular operating mode based on an operating parameter to enable the HVAC&R system 100 to operate efficiently.

For example, the operating parameter may include an amount of liquid (e.g., lubricant liquid) in the sump 102, as detected by a liquid level indicator 136 of the sump 102. The controller 130 may be communicatively coupled to the liquid level indicator 136 and may be configured to adjust operation of the HVAC&R system 100 (e.g., between the normal operating mode and the lubricant return operating mode) based on the amount of liquid in the sump 102, as indicated by the liquid level indicator 136. As an example, if the liquid level indicator 136 provides feedback indicative of the amount of liquid in the sump 102 being below a threshold level, the controller 130 may transmit a signal to adjust one or more components the HVAC&R system 100 (e.g., the expansion device 110 and/or the compressor 106) to initiate operation in the lubricant return operating mode. In additional or alternative embodiments, the controller 130 may transmit a signal to adjust operation of the one or more components of the HVAC&R system 100 based on feedback indicative of another operating parameter, such as a temperature and/or pressure of the refrigerant in the refrigerant circuit 104, a concentration of lubricant in the refrigerant circuit 104 (e.g., in the evaporator 112), a pressure of the refrigerant in the condenser 108, an operating parameter associated with operation of the compressor 106, an interval of time, another suitable operating parameter, or any combination thereof. In further embodiments, the controller 130 may receive user feedback (e.g., a user input) that instructs the controller 130 to operate the HVAC&R system 100 in the lubricant return operating mode. That is, an operator of the HVAC&R system 100 may input a target level of lubricant in the sump 102, and the controller 130 may transmit a signal to adjust the one or more components of the HVAC&R system 100 to initiate the lubricant return operating mode based on the target level input by the operator.

Figure 6:
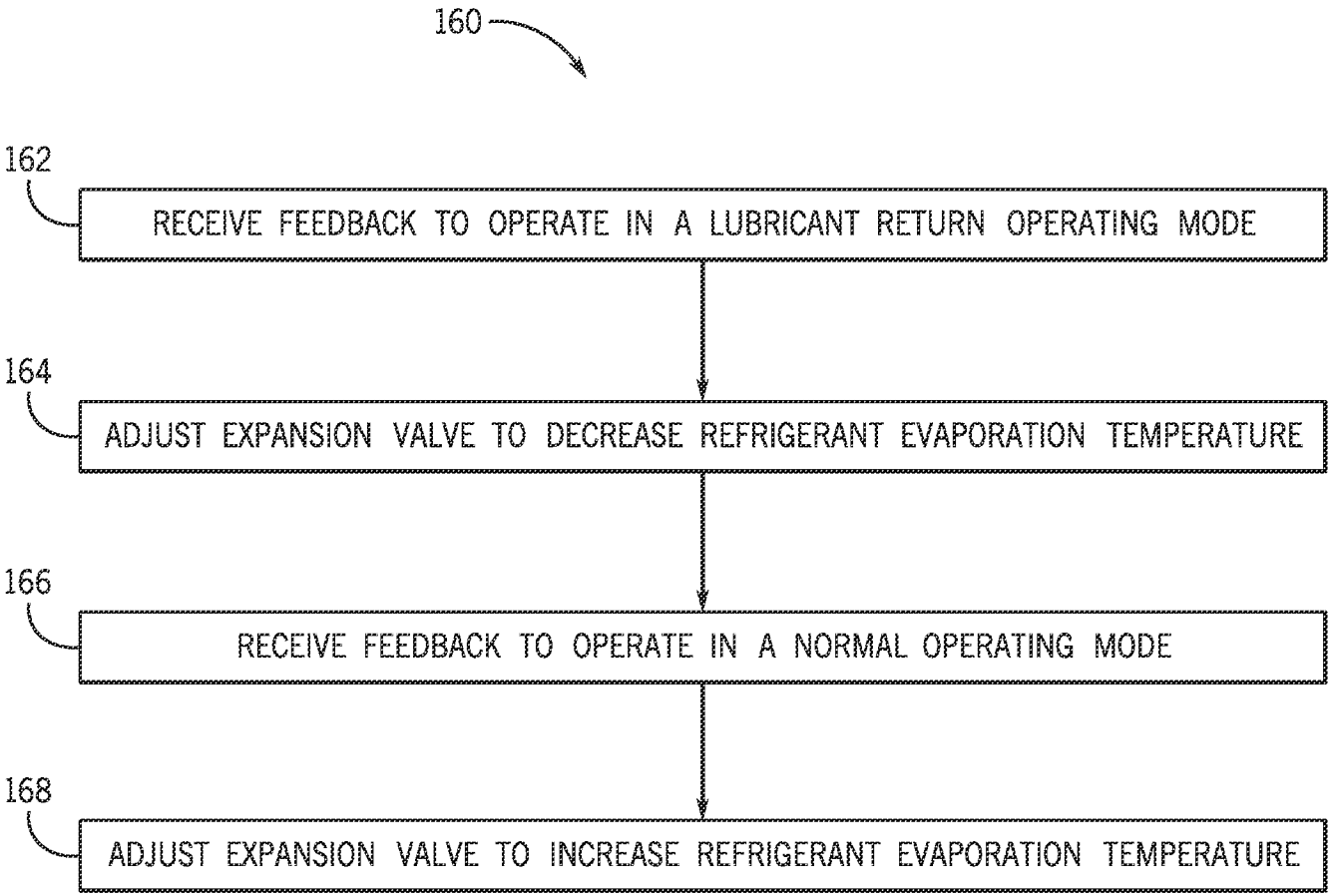
FIG. 6 is a block diagram of an embodiment of a method for operating the lubricant return system of FIG. 5 to transition between a lubricant return operating mode and a normal operating mode, in accordance with an aspect of the present disclosure.

FIG. 6 is a block diagram of an embodiment of a method or process 160 that may be utilized to operate the HVAC&R system 100 in the lubricant return operating mode. Although FIG. 6 depicts one embodiment of the method 160, a similar method or process may additionally or alternatively be performed in other embodiments of the HVAC&R system 100 having a different arrangement or configuration (e.g., of the refrigerant circuit 104). Moreover, further steps may be performed in addition to the method 160, and/or certain steps of the depicted method 160 may be modified, removed, and/or performed in a different order than shown in FIG. 6. In some embodiments, the method 160 may be performed by one or more controllers, such as the controller 130.

At block 162, the controller 130 receives feedback indicative of operation of the HVAC&R system 100 in the lubricant return operating mode. The feedback may be indicative that a level of lubricant in the sump 102 is below a threshold level, and the feedback may be received by the controller 130 from the liquid level indicator 136. The feedback may additionally or alternatively be indicative of another operating parameter and may be transmitted by another suitable sensor of the HVAC&R system 100, for example. The feedback may further include a user input transmitted by an operator of the HVAC&R system 100 and indicative of a target level of lubricant in the sump 102, such that the HVAC&R system 100 transitions to the lubricant return operating mode (e.g., to override a current operation in the normal operating mode).

In response to determining that the HVAC&R system 100 should operate in the lubricant return operating mode, the controller 130 may transmit a signal to adjust the position of the expansion device 110 to reduce an evaporating temperature of the refrigerant in the evaporator 112, as shown at block 164. For example, the controller 130 may transmit a signal to adjust the position of the expansion device 110 to reduce the pressure of the refrigerant directed to the evaporator 112 to a pressure that is lower than that during the normal operating mode. However, the temperature of the conditioning fluid exiting the evaporator 112 in the lubricant return operating mode may remain substantially the same compared to that in the normal operating mode. By way of example, a target evaporator outlet temperature of the conditioning fluid exiting the evaporator 112 after exchanging heat with the refrigerant may remain substantially the same in the lubricant return operating mode as that in the normal operating mode. For instance, the evaporating temperature of the refrigerant in the lubricant return operating mode may be reduced to 4 degrees Celsius, 3 degrees Celsius, 2 degrees Celsius, or another suitable temperature. Further, the evaporator outlet temperature of the conditioning fluid may remain, relative to an evaporator outlet temperature of the condition fluid in the normal operating mode, at 6 degrees Celsius, 7 degrees Celsius, 8 degrees Celsius, or another suitable temperature. In this way, during the lubricant return operating mode, a temperature differential (e.g., a small temperature differential) between the evaporating temperature of the refrigerant and the evaporator outlet temperature of the conditioning fluid may increase. By increasing such temperature differential, an increased amount of refrigerant may be vaporized in the evaporator 112 to accumulate a greater concentration of lubricant liquid in the evaporator 112. As a result, a flow of the liquid drawn into the ejector 116 contains a greater amount of lubricant to thereby increase the level of lubricant within the sump 102. In some embodiments, the lubricant return operating mode includes a first target flow rate of lubricant into the sump 102, and the controller 130 is configured to instruct the expansion device 110 to adjust to a first position based on the first target flow rate.

At block 166, the controller 130 receives feedback indicative of operation of the HVAC&R system 100 in the normal operating mode. For example, the feedback may be received from the liquid level indicator 136 and may indicate that the level of lubricant in the sump 102 is at or above the threshold level. The feedback may additionally or alternatively be indicative of another operating parameter and/or may include a user input (e.g., to override current operation in the lubricant return operating mode) transmitted by the operator of the HVAC&R system 100.

To transition from the lubricant return operating mode to the normal operating mode, the controller 130 may transmit a signal to adjust the position of the expansion device 110 to increase the pressure of the refrigerant directed to the evaporator 112, thereby increasing the evaporating temperature of the refrigerant in the evaporator 112, as shown at block 168. That is, the controller 130 may transmit a signal to adjust the expansion device 110 to increase the pressure within the evaporator 112. In certain implementations, the normal operating mode may include a second target flow rate of lubricant into the sump 102 that is less than the first target flow rate of lubricant into the sump 102. The controller 130 may be configured to instruct the expansion device 110 to adjust to a second position to achieve the second target flow rate of lubricant into the sump 102 by increasing the pressure within the evaporator 112. In some cases, increasing the pressure within the evaporator 112 may reduce an amount of lubricant liquid directed to the sump 102, but the HVAC&R system 100 may cool the conditioning fluid more efficiently than during operation in the lubricant return operating mode.

FIG. 7 is a schematic view of an embodiment of the HVAC&R system 100 having the lubricant circuit 101, which includes the sump 102 configured to direct the lubricant to the compressor 106. The illustrated embodiment of the HVAC&R system 100 in FIG. 7 may also be configured to operate in the lubricant return operating mode to increase the amount of lubricant in the sump 102. For example, the HVAC&R system 100 may be configured to increase the pressure of the fluid entering the first input 120 of the ejector 116 to initiate the lubricant return operating mode. As illustrated in FIG. 7, the lubricant circuit 101 additionally includes a compressor line 200 configured to direct high pressure vapor or gas from the compressor 106 to the first input 120 of the ejector 116. In some embodiments, the high pressure vapor or gas directed to the ejector 116 via the compressor line 200 may have a higher pressure than the high pressure vapor or gas directed to the ejector 116 via the condenser line 118 (e.g., from the condenser 108). Directing fluid having a higher pressure through the ejector 116 may increase the suction force that draws fluid from the evaporator 112 (e.g., increasing the pressure of fluid directed to the first input 120 reduces a pressure within the ejector 116 to draw fluid to flow fluid into the ejector 116 via the second input 124 at an increased flow rate). As such, increasing the pressure of fluid directed to the first input 120 may increase the flow rate of lubricant directed into the ejector 116 and into the sump 102.

To operate the HVAC&R system 100 in the lubricant return operating mode, the controller 130 may block fluid flow (e.g., a first fluid flow) through the condenser line 118 to the first input 120 and/or enable fluid flow (e.g., a second fluid flow) through the compressor line 200 to the first input 120. In some embodiments, a first valve 202 may be positioned along the condenser line 118, and a second valve 204 may be positioned along the compressor high pressure line 200. In the normal operating mode, the controller 130 may open the first valve 202 to enable high pressure vapor to flow from the condenser 108 to the ejector 116 and may close the second valve 204 to block high pressure vapor from flowing from the compressor 106 to the ejector 116. In the lubricant return operating mode, the controller 130 may open the second valve 204 to enable high pressure vapor to flow from the compressor 106 to the ejector 116 and may close the first valve 202 to block high pressure vapor from flowing from the condenser 108 to the ejector 116. In additional or alternative lubricant return operating modes, the controller 130 may transmit a signal to alternatively enable an amount of high pressure vapor to flow through both the compressor line 200 and the condenser line 118 simultaneously.

In certain embodiments, the first valve 202 and/or the second valve 204 may each include on-off valves configured to transition between a fully open position to enable fluid flow and a fully closed position to block fluid flow through the respective lines 118, 200. As such, the first valve 202 and/or the second valve 204 may not be configured to transition to an intermediate position between the fully open position and the fully closed position to enable high pressure vapor to flow at a particular rate. In other embodiments, the first valve 202 and/or the second valve 204 may each be configured to transition to a position between the fully open position and the fully closed position in order to control the flow rate of high pressure vapor flowing to the ejector 116 through the respective lines 118, 200. The first valve 202 and/or the second valve 204 may each include solenoid valves configured to actuate to a specific position based on receiving an electrical signal (e.g., a voltage signal) from the controller 130. As such, the controller 130 may be configured to transmit a signal to the first valve 202 and/or the second valve 204 to transition operation of the HVAC&R system 100 between the normal operating mode and the lubricant return operating mode. For instance, the first valve 202 and/or the second valve 204 may each be configured to transition to the closed position upon receiving a respective signal from the controller 130.

Thus, the controller 130 may transmit an electrical signal to the first valve 202 to close the first valve 202 and block high pressure vapor from flowing to the first input 120 of the ejector 116 via the condenser line 118 to operate the HVAC&R system 100 in the lubricant return operating mode. The controller 130 may also interrupt or discontinue an electrical signal from being transmitted to the second valve 204 in the lubricant return operating mode to position the second valve 204 in the open position and enable high pressure vapor to flow to the first input 120 of the ejector 116 via the compressor line 200. Moreover, the controller 130 may transmit another electrical signal to the second valve 204 to close the second valve 204 and block high pressure vapor from flowing to the first input 120 via the compressor line 200 to operate the HVAC&R system 100 in the normal operating mode. The controller 130 may also interrupt or discontinue the electrical signal from being transmitted to the first valve 202 in the normal operating mode to position the first valve 202 in the open position and enable high pressure vapor to flow to the first input 120 via the condenser line 118.

Additionally or alternatively, the controller 130 may be communicatively coupled to the compressor 106 and may be configured to adjust various components of the compressor 106 to control the pressure of the high pressure vapor directed to the ejector 116 via the compressor line 200. For instance, FIG. 8 is a partial cross-section of an embodiment of the compressor 106 of the HVAC&R system 100 configured to pressurize a fluid (e.g., a refrigerant and lubricant mixture) to form high pressure vapor that may be directed to the ejector 116. In the illustrated embodiment, the compressor 106 includes an impeller 230 coupled to a shaft 232 disposed within, or otherwise surrounded by, a journal bearing 234. The shaft 232 may be configured to rotate to drive rotation of the impeller 230. Rotation of the impeller 230 draws vapor (e.g., vapor mixture of refrigerant and/or lubricant) into an inlet 226 of the compressor 106 and toward a diffusion passage 238 of the compressor 106 along a flow direction 240. The vapor may then flow through the diffusion passage 238, where kinetic energy of the vapor is converted to pressure energy, thereby increasing the pressure of the vapor.

The compressor 106 may further include a diffuser ring 242 configured to adjust a geometry (e.g., a cross-sectional area) of the diffusion passage 238. As an example, the diffuser ring 242 may be configured to move in a first direction 244 to reduce the cross-sectional area of the diffusion passage 238 and configured to move in a second direction 246 to increase the cross-sectional area of the diffusion passage 238. Reducing the cross-sectional area of the diffusion passage 238 increases a pressure in an area 248 of the compressor 106 upstream of the diffuser ring 242 with respect to the flow direction 240 of the fluid, thereby increasing a pressure of fluid flowing through the diffusion passage 238.

The compressor line 200 may be fluidly coupled to the diffusion passage 238 proximate to the area 248 to enable at least a portion of the fluid (e.g., high pressure refrigerant and/or lubricant) flowing through the diffusion passage 238 to flow through the compressor line 200 (e.g., when the second valve 204 is in the open position). That is, as fluid flows through the diffusion passage 238, a first portion of the fluid may flow past the diffuser ring 242 through the diffusion passage 238, and a second portion of the fluid may flow through the compressor line 200 toward the ejector 116. As the diffuser ring 242 moves in the first direction 244 to reduce the geometry of the diffusion passage 238, the pressure of the fluid may increase in the area 248. As a result, the fluid directed through the compressor line 200 and into the first input 120 may have an increased pressure that drives or draws the lubricant to flow from the evaporator 112 to the second input 124 at an increased flow rate. Therefore, moving the diffuser ring 242 in the first direction 244 may increase the flow rate of the lubricant directed into the sump 102. Thus, the controller 130 may be configured to transmit a signal to adjust a position of the diffuser ring 242 in the first direction 244 to decrease the cross-sectional area of the diffusion passage 238 and increase the pressure of fluid directed to the ejector 116 in order to operate the HVAC&R system 100 in the lubricant return operating mode.

In additional or alternative embodiments, the controller 130 may transmit a signal to adjust a rotational speed of the impeller 230 in the lubricant return operating mode. For example, the controller 130 may transmit a signal to increase the rotational speed of the impeller 230, such that fluid may flow into the diffusion passage 238 at a greater rate to increase a flow rate of the fluid and/or a pressure of the fluid in the area 248. The increased pressure at the area 248 may also increase the pressure of the fluid directed to the first input 120 of the ejector 116 to enable a greater amount of lubricant to be drawn from the evaporator 112 via the ejector 116.

In some implementations, the controller 130 may be configured to increase the pressure in the area 248 to a target pressure level. To this end, the controller 130 may be communicatively coupled to a sensor 250 configured to determine a current pressure level in the area 248. Thus, the controller 130 may receive sensor data indicative of the current pressure level from the sensor 250, compare the current pressure level with the target pressure level, and transmit a signal to adjust the position of the diffuser ring 242 and/or the rotational speed of the impeller 230 accordingly to achieve the target pressure level.

FIG. 9 is a block diagram of an embodiment of a method or process 260 for operating the HVAC&R system 100 of FIG. 7 in the lubricant return operating mode. The method 260 may be modified to enable an HVAC&R system having a different arrangement and/or configuration to operate in the lubricant return operating mode. Further, the steps of the method 260 may be combined with the steps of the method 160 such that any steps described with respect to methods 160, 260 may be used to increase the amount of lubricant in the sump 102.

At block 262, the controller 130 receives feedback indicative of operation of the HVAC&R system 100 in the lubricant return operating mode. The feedback may include an operating parameter, such as liquid level in the sump 102 (e.g., received from the liquid level indicator 136), a temperature and/or pressure of the refrigerant in the refrigerant circuit 104, a concentration of lubricant in the refrigerant circuit 104, a pressure in the condenser 108, an operating parameter associated with operation of the compressor 106, an interval of time, another suitable operating parameter, or any combination thereof. The feedback may also include a user input (e.g., received via a user interface of the HVAC&R system 100) to override a current operation of the HVAC&R system 100.

At block 264, the controller 130 transmits a signal to adjust the position of the first valve 202 and/or the second valve 204 of the lubricant circuit 101 in response to receipt of the feedback to operate the HVAC&R system 100 in the lubricant return operating mode. In certain embodiments, the controller 130 may instruct the second valve 204 to open to enable fluid flow through the compressor line 200 and may instruct the first valve 202 to close to block fluid flow through the condenser line 118. In other embodiments, the controller 130 may enable some fluid flow through the condenser line 118 in addition to the fluid flow through the compressor line 200.

At block 266, the controller 130 may also transmit a signal to increase the pressure at the area 248 of the diffusion passage 238 in the compressor 106. As mentioned above, the controller 130 may increase the pressure at the area 248 by transmitting a signal to move the diffuser ring 242 in the first direction 244 to decrease a cross-sectional area of the diffusion passage 238 and/or may transmit a signal to increase a rotational speed of the impeller 230. In certain embodiments, the controller 130 may instruct the diffuser ring 242 to move in the first direction 244 to a target position and/or may instruct the impeller 230 to rotate at a target speed to achieve a target pressure of the refrigerant in the area 248.

At block 268, the controller 130 receives feedback indicative of operation of the HVAC&R system 100 in the normal operating mode. That is, the controller 130 may receive feedback indicative of an operating parameter (e.g., a level of lubricant in the sump 102) and/or a user input to operate the HVAC&R system 100 in the normal operating mode. To transition from the lubricant return operating mode to the normal operating mode, the controller 130 may transmit a signal to adjust the positions of the first valve 202 and the second valve 204, as shown at block 270. For example, the controller 130 may transmit a signal to adjust the second valve 204 to the closed position to block fluid flow through the compressor line 200 and/or to adjust the first valve 202 to an open position to enable fluid flow through the condenser line 118. As a result, the first input 120 of the ejector 116 may receive high pressure fluid from the condenser 108.

Additionally or alternatively, the controller 130 may transmit a signal to decrease the pressure at the area 248, as shown at block 272. By way of example, the controller 130 may transmit a signal to adjust the diffuser ring 242 to move in the second direction 246 to increase the cross-sectional area of the diffusion passage 238 and/or instruct the impeller 230 to rotate at a reduced rotational speed. The position of the diffuser ring 242 and/or the rotational speed of the impeller 230 in the normal operating mode may be based on the feedback, such as an amount of lubricant in the sump 102. Decreasing the pressure at the area 248 may reduce a rate at which lubricant is directed from the refrigerant circuit 104 to the sump 102, but may enable the HVAC&R system 100 to operate (e.g., to cool the conditioning fluid) more efficiently, for example.

Embodiments of the present disclosure are directed to an HVAC&R system that includes a lubricant circuit for circulating a lubricant to components of the HVAC&R system. The lubricant circuit may include a sump configured to direct the lubricant to a refrigerant circuit (e.g., to a compressor) of the HVAC&R system. The lubricant circuit may further include an ejector configured to draw liquid that contains the lubricant from the refrigerant circuit (e.g., from an evaporator) to the sump. For example, a high pressure vapor (e.g., from a condenser) may be directed to the ejector to generate a suction force (e.g., a vacuum or reduced pressure) that draws the liquid (e.g., from an evaporator) toward the sump. In some embodiments, the ejector may not adequately draw the lubricant into the sump, such that a lubricant level in the sump decreases. As such, the HVAC&R system may transition operating modes to a lubricant return operating mode.

In the lubricant return operating mode, a position of an expansion device of the HVAC&R system may be adjusted such that the evaporating temperature of the refrigerant is decreased and/or a pressure within the evaporator decreases. As such, a concentration of lubricant drawn by the ejector may increase, and the flow rate at which the lubricant is directed into the sump may increase. In additional or alternative embodiments, during the lubricant return operating mode, the high pressure vapor entering the ejector may be directed from an intake of the compressor of the HVAC&R system. Furthermore, operation of the compressor may be adjusted to increase the pressure of the fluid directed toward the ejector, which may increase the flow rate at which liquid is drawn by the ejector and directed into the sump. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning, and/or refrigeration (HVAC&R) system, comprising:

a refrigerant circuit configured to flow a refrigerant therethrough;

a condenser positioned along the refrigerant circuit and configured to receive the refrigerant from a compressor positioned along the refrigerant circuit;

a sump configured to direct a lubricant to the compressor positioned along the refrigerant circuit, wherein the sump and the condenser are separate from one another, and wherein the lubricant directed to the compressor and the refrigerant directed through the refrigerant circuit are different fluids;

an ejector configured to direct the lubricant from the refrigerant circuit to the sump;

an expansion device positioned along the refrigerant circuit and configured to reduce a pressure of the refrigerant directed through at least a portion of the refrigerant circuit; and a controller configured to adjust operation of the HVAC&R system between a first mode and a second mode, wherein the controller is configured to instruct the expansion device to adjust to a first position to enable the ejector to direct the lubricant from the refrigerant circuit to the sump at a first target flow rate in the first mode, and wherein the controller is configured to instruct the expansion device to adjust to a second position to enable the ejector to direct the lubricant from the refrigerant circuit to the sump at a second target flow rate in the second mode.

2. The HVAC&R system of claim 1, wherein the second target flow rate is greater than the first target flow rate.

3. The HVAC&R system of claim 2, comprising an evaporator positioned along the refrigerant circuit and configured to receive the refrigerant from the expansion device, wherein an evaporating temperature of the refrigerant in the evaporator is a first evaporating temperature in the first mode, wherein the evaporating temperature of the refrigerant in the evaporator is a second evaporating temperature in the second mode, and wherein the second evaporating temperature is less than the first evaporating temperature.

4. The HVAC&R system of claim 1, wherein the ejector is configured to draw liquid from an evaporator positioned along the refrigerant circuit and direct the liquid to the sump.

5. The HVAC&R system of claim 1, wherein the controller is configured to transition the HVAC&R system between operating in the first mode and operating in the second mode based on feedback indicative of an operating parameter of the HVAC&R system.

6. The HVAC&R system of claim 5, wherein the sump comprises a liquid level indicator configured to provide feedback to the controller indicative of an amount of liquid in the sump, and wherein the controller is configured to adjust the HVAC&R system to operate in the second mode in response to feedback indicative of the amount of liquid in the sump being below a threshold amount.

7. The HVAC&R system of claim 1, wherein the lubricant comprises oil.

8. The HVAC&R system of claim 1, wherein the first mode corresponds to a normal operating mode of the HVAC&R system and the second mode corresponds to a lubricant return mode of the HVAC&R system, and wherein the ejector, during operation of the HVAC&R system, directs a greater amount of the lubricant into the sump in the lubricant return mode relative to the normal operating mode.

9. A heating, ventilation, air conditioning, and/or refrigeration (HVAC&R) system, comprising:

a refrigerant circuit configured to flow a refrigerant therethrough;

a sump configured to direct a lubricant to a compressor positioned along the refrigerant circuit, wherein the lubricant and the refrigerant are different fluids;

an ejector configured to direct the lubricant from the refrigerant circuit to the sump, wherein the ejector comprises an inlet fluidly coupled to a condenser positioned along the refrigerant circuit and an outlet fluidly coupled to the sump;

an expansion device positioned along the refrigerant circuit and configured to reduce a pressure of the refrigerant directed through at least a portion of the refrigerant circuit; and a controller configured to adjust operation of the HVAC&R system between a first mode and a second mode, wherein the controller is configured to instruct the expansion device to adjust to a first position to cause the ejector to direct the lubricant from the refrigerant circuit to the sump at a first target flow rate in the first mode, and the controller is configured to instruct the expansion device to adjust to a second position to cause the ejector to direct the lubricant from the refrigerant circuit to the sump at a second target flow rate in the second mode.

10. The HVAC&R system of claim 1, wherein the ejector is configured to receive a first mixture of the refrigerant and the lubricant from the condenser via an inlet of the ejector and to discharge a second mixture of the refrigerant and the lubricant toward the sump via an outlet of the ejector.

11. The HVAC&R system of claim 3, wherein a concentration of the lubricant within the evaporator is a first concentration in the first mode, wherein the concentration of the lubricant within the evaporator is a second concentration in the second mode, and wherein the second concentration is greater than the first concentration based on the second evaporating temperature of the refrigerant in the second mode being less than the first evaporating temperature of the refrigerant in the first mode.

12. The HVAC&R system of claim 9, wherein the inlet is directly coupled to the condenser and the outlet is directly coupled to the sump.

* * * * *